United States Patent [19]

Fiorenzo

[11] Patent Number: 4,881,743

[45] Date of Patent: Nov. 21, 1989

[54] SCENT HEAD ARROW

[76] Inventor: William S. Fiorenzo, 49A Traphaen Rd., Wayne, N.J. 07470

[21] Appl. No.: 203,890

[22] Filed: Jun. 8, 1988

[51] Int. Cl.[4] ..... F41B 5/02

[52] U.S. Cl. ..... 273/418

[58] Field of Search ..... 273/418; 239/53–59, 239/34, 36

[56] References Cited

U.S. PATENT DOCUMENTS

| | | | |
|---|---|---|---|
| 1,027,856 | 5/1912 | Kocher | 239/59 X |
| 2,560,681 | 7/1951 | Berkowitz | 239/36 X |
| 2,568,919 | 9/1951 | Kaye | 239/56 X |
| 2,791,058 | 5/1957 | Bettini | 239/57 X |
| 3,457,921 | 7/1969 | Waldeisen | 273/418 X |
| 3,515,302 | 6/1970 | Curran | 239/57 X |
| 3,565,435 | 2/1971 | Bear | 273/418 |
| 3,817,371 | 6/1974 | Gatter | 239/57 X |
| 3,893,866 | 7/1975 | Hollingsworth | 273/418 |
| 3,953,934 | 5/1976 | Visser | 239/54 X |
| 3,955,706 | 5/1976 | Whitaker | 239/55 X |
| 4,219,145 | 8/1980 | Jaeschke et al. | 239/59 X |
| 4,726,584 | 2/1988 | Bishop | 273/418 |

OTHER PUBLICATIONS

Gander Mountain, Inc. Catalog, p. 76, Scent Shuttle, ©1986.

*Primary Examiner*—Paul E. Shapiro

*Attorney, Agent, or Firm*—Leon Gilden

[57] ABSTRACT

A scent head arrow is set forth wherein an elongate scent head is frictionally securable proximate a forward end of an associated arrow when slid thereover. The scent head contains a first series including a plurality of equally spaced elongate slots parallel to the axis of the arrow and a second series rearwardly of radial slots. The arrow accordingly distributes scent for attracting game animals and the like during its flight and impact. Additionally, the scent head may be provided with vanes integrally secured on a forwardmost conical portion of the scent head for imparting rotation of the scent head to enhance distribution of the included scent during flight of the arrow.

2 Claims, 2 Drawing Sheets

SCENT HEAD ARROW

BACKGROUND OF THE INVENTION

1. Field of the Invention

The present invention relates to scent distribution devices, and more particularly pertains to a new and improved scent head arrow which distributes a game animal scent for attraction of the same or conversely may include an animal repulsion scent for repelling of certain unwanted animals.

2. Description of the Prior Art

The use of arrows as material-supporting vehicles is known in the prior art. Traditionally, these arrows have imparted a drug into an animal or have distributed a scent on impact. Examples of such arrows may be found in U.S. Pat. No. 3,417,994 to Rohrbaugh defining an arrow for discharge of an extenuous line of marking yarn upon embedding in a fleeing game animal to enable following of the animal. A yarn holding bobbin is positioned within a forwardmost portion of the arrow wherein the arrow in flight, or upon embedding in a moving game animal, effects unraveling of the yarn to enable tracking. The Rohrbaugh device is of interest relative to the teaching of an arrow for supporting, carrying and discharging yarn from within said arrow for providing a trail for tracking purposes.

U.S. Pat. No. 3,565,435 to Bear sets forth an arrow supporting means located between the head and the shaft for dispensing of a tranquilizing preparation into the flesh of an animal struck by the arrow. The Bear patent provides no teaching of continuous discharge of a scent composition, as does the instant invention.

U.S. Pat. No. 3,893,866 to Hollingsworth sets forth an arrow containing a sleeve slidingly telescoped over a shank of the arrow that is provided with a recess. The recess provides a compartment for the inclusion of fluid material for direct communication with the interior of a target, such as an animal, struck by the arrow.

U.S. Pat. No. 4,093,229 to Kelling sets forth an arrow including a hollow shaft open at a forward end wherein holes are formed through the shaft where a trail-indicating dye included within the arrow is released upon the arrow striking a target which impacts upon a piston within the arrow that is driven rearwardly upon impact to release the dye.

As such, it may be appreciated that there is a continuing need for both a new and improved scent head arrow, as set forth by the instant invention, which addresses both the problem of distribution of a desired animal scent during flight and impact of the arrow and in this respect, the present invention substantially fulfills this need.

SUMMARY OF THE INVENTION

In view of the foregoing disadvantages inherent in the known types of material conveying arrows now present in the prior art, the present invention provides an scent head arrow wherein the same provides for efficient and effective securement of a scent head to a conventional arrow that may be conveniently stored during periods of non-use. As such, the general purpose of the present invention, which will be described subsequently in greater detail, is to provide a new and improved scent head arrow which has all the advantages of the prior art material conveying arrows and none of the disadvantages.

To attain this, the present invention comprises a containerized scent head formed with a forward concial surface and a main body formed of a generally cylindrical shape that contains a plurality of diametrically opposed elongate slots coextensive in a line parallel to the axis of an associated arrow, and a second series of radial slots formed on a rear surface of the scent head. Forwardly positioned vanes may be utilized on the scent head arrow for imparting a twist to the arrow to aid in distribution of the scent during flight of the arrow, as well as on impact.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. These are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determined quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scent head arrow which has all the advantages of the prior art scent head arrows and none of the disadvantages.

It is another object of the present invention to provide a new and improved scent head arrow which may be easily and efficiently manufactured and marketed.

It is a further object of the present invention to provide a new and improved scent head arrow which is of a durable and reliable construction.

An even further object of the present invention is to provide a new and improved scent head arrow which is susceptible of a low cost of manufacture with regard to both materials and labor, and which accordingly is then susceptible of low prices of sale to the consuming public, thereby making such scent head arrow economically available to the buying public.

Still yet another object of the present invention is to provide a new and improved scent head arrow which provides in the apparatuses and methods of the prior art some of the advantages thereof, while simultaneously overcoming some of the disadvantages normally associated therewith.

Still another object of the present invention is to provide a new and improved scent head arrow that is formed with a containerized scent head that is positionable at a forwardmost portion of the arrow wherein the head is formed with a cylindrical body containing elongate slots for distribution of scent therethrough contained within the scent head and with a forward conical surface that may be provided with optional vanes for imparting rotation to the arrow to enhance distribution of scent contained within the arrow during flight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings therein.

DESCRIPTION OF THE PREFERRED EMBODIMENT

Figures 1, 2:
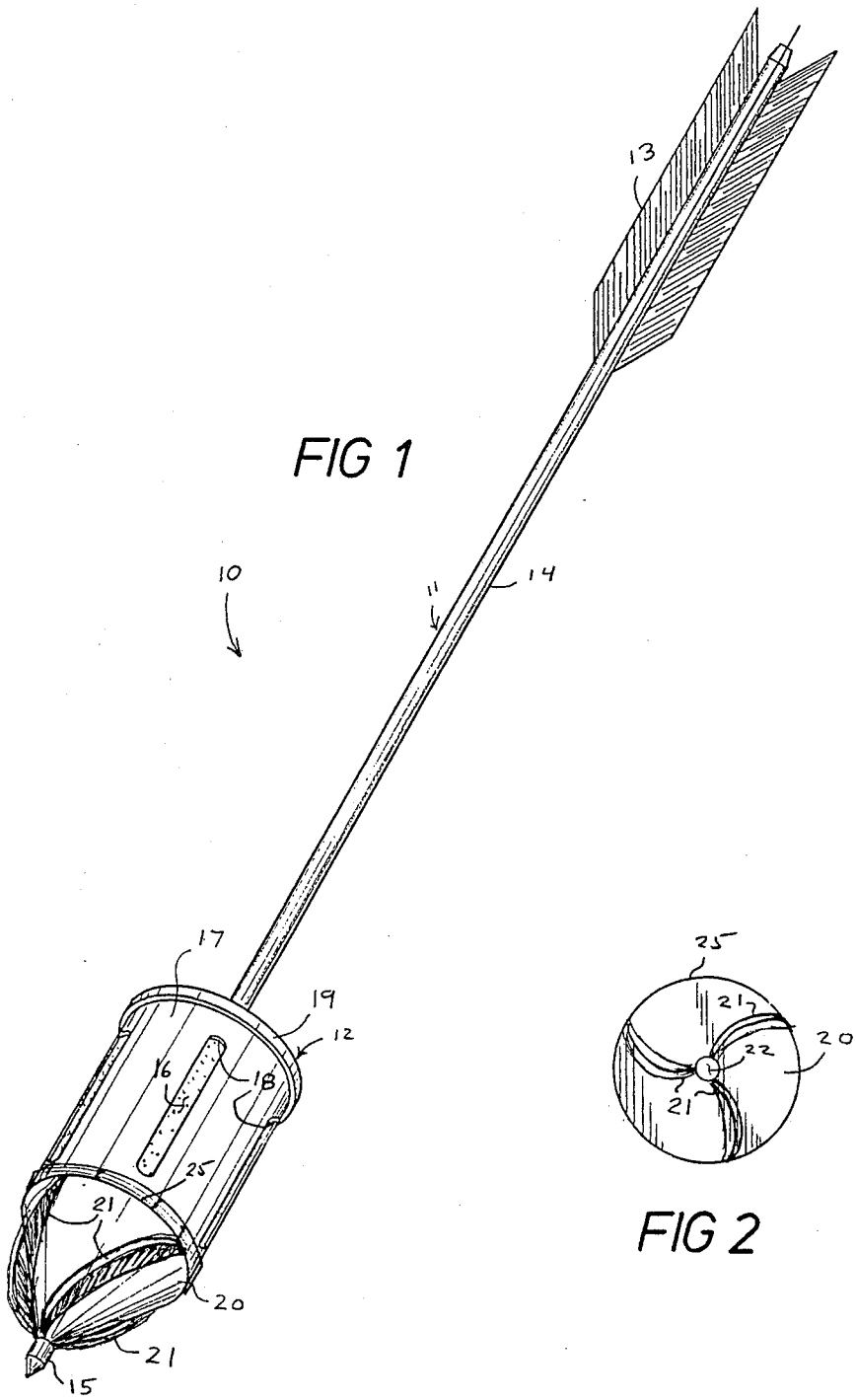
FIG. 1 is an isometric illustration of the instant invention.
FIG. 2 is a forward orthographic view of the instant invention prior to insertion upon an arrow.

With reference now to the drawings, and in particular to FIGS. 1 to 5 thereof, a new and improved scent head arrow embodying the principles and concepts of the present invention and generally designated by the reference numeral 10 will be described.

More specifically, it will be noted that the scent head arrow apparatus 10 essentially comprises a conventional arrow 11 formed with a series of guidance feathers 13 at one distal end of the shaft 14 and a forward tip 15 secured to the other distal end of the shaft 14.

A scent head 12 is formed with a generally elongate cylindrical body 17 including a series of diametrically opposed elongate slots 18 oriented in a direction parallel to the axis of the body 17 and arrow shaft 14. Contained within a cylindrical body 17 is a fibrous scent filled carrier 16 containing an animal scent, such as a commercially available deer attractant, for attracting a game animal or conversely may contain a repellent to repel undesirable animals from within an area.

Figure 5:
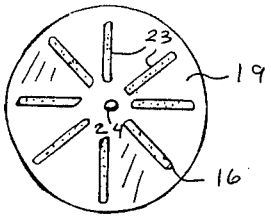
FIG. 5 is a top orthographic view of the scent head, as illustrated in FIG. 3.

A top cap 19 of the scent head 12 is secured to the cylindrical body 17 with an overlying lip **19*a* to effect a snap-fit over the body 17. As illustrated in FIG. 5, a central top cap opening 24 is formed centrally of the cap 19 for acceptance of the arrow 11 therethrough and is formed with a series of radial cap slots 23 to provide a further scent head series of openings in addition to the slots 18 wherethrough the scent contained by the carrier 16** may emanate therefrom.

The lower conical cap 20 is also formed with a lip **20*a* for overlying securement to the body 17 in a similar snap-fit manner as the top cap 19. The lower cap 20, as illustrated in FIGS. 1 and 2, is formed with a series of vanes 21 directed from the central opening 22 for acceptance of the arrow 14 therethrough to the outer lower cap perimeter 25 spaced at at approximately 120 degrees of arc apart to effect a rotation of the scent head 12 to accelerate the withdrawal of scent from the carrier 16 and enhance the scent throughout the flight of the arrow 11**.

Figure 3:
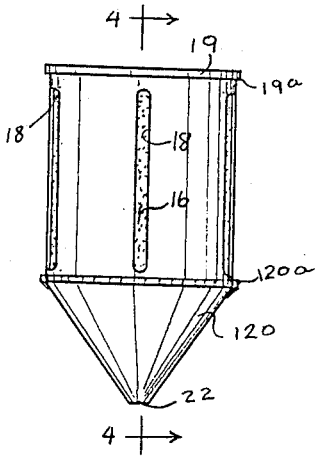
FIG. 3 is an orthographic view taken in elevation of the instant invention prior to insertion upon an arrow illustrating the absence of vanes on a forwardmost portion thereof.
Figure 4:
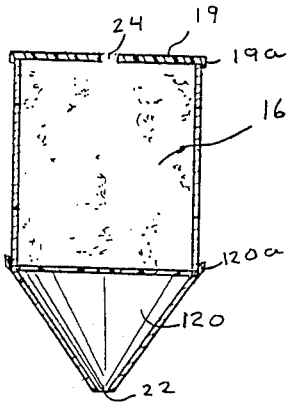
FIG. 4 is an orthographic view taken along the lines 4—4 of FIG. 3 in the direction indicated by the arrows.

It may be noted that FIGS. 3 through 5 illustrate the forward cap 120 without the vanes thereon to limit the effect of scent distribution through the flight of the arrow and effect a greater distribution of the scent upon impact of the arrow by eliminating the rotational effect of the vanes 21.

The manner of usage and operation of the present invention therefore should be apparent from the above description and accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A scent head arrow for imparting an animal scent during flight and impact of the arrow comprising, an arrow including guidance means at one end of said arrow and a weighted forward tip secured to a forward portion of said arrow, and a scent head container means arranged for securement to the arrow adjacent the tip, and said scent head container including a cylindrical body, a top cap securable to an uppermost end of said body, and a forward conical cap for securement to a lowermost end of said body, and scent means contained within said scent head container for distributing scent throughout the flight and impact of said arrow through openings formed in said scent head container, and wherein said openings include a plurality of radial slots formed in said top cap, and wherein openings further include a series of slots formed in said cylindrical body arranged parallel to the axis of said cylindrical body, and wherein said top cap and forward conical cap include central openings for accepting said arrow therethrough, and wherein said conical cap is formed with a series of vanes for imparting rotation to said arrow during flight of said arrow.

2. A scent head arrow as set forth in claim 1 wherein said top cap and said forward conical cap are secured to said cylindrical body by a snap-fit arrangement to enable replenishment of said scent means.

* * * * *